US007648382B1

(12) United States Patent
Polnyi

(10) Patent No.: US 7,648,382 B1
(45) Date of Patent: Jan. 19, 2010

(54) SOCKET WITH LATCHING UNIT

(75) Inventor: Igor Polnyi, Aurora, IL (US)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 12/317,972

(22) Filed: Dec. 31, 2008

(51) Int. Cl.
*H01R 13/62* (2006.01)

(52) U.S. Cl. ..... 439/330; 439/71; 439/352

(58) Field of Classification Search ..... 439/330, 439/71, 352, 73, 350, 525, 526
See application file for complete search history.

(56) References Cited

U.S. PATENT DOCUMENTS 6,648,663 B2 * 11/2003 Corisis et al. ..... 439/330
6,837,731 B2 * 1/2005 Corisis et al. ..... 439/330
2002/0076967 A1 * 6/2002 Corisis et al. ..... 439/330
2002/0081886 A1 * 6/2002 Corisis et al. ..... 439/330
2002/0111058 A1 * 8/2002 Corisis et al. ..... 439/330
2002/0197900 A1 * 12/2002 Corisis et al. ..... 439/330
2003/0064618 A1 * 4/2003 Chandran et al. ..... 439/330

* cited by examiner

*Primary Examiner*—Gary F. Paumen
(74) *Attorney, Agent, or Firm*—Andrew C. Cheng; Wei Te Chung; Ming Chieh Chang

(57) ABSTRACT

A socket adapted for electrically connecting a module, comprises a board-like housing, and a plurality of latching units provided on the housing for retaining the module. Each latching unit has at least one latching arm and a silicon plug abutting against the latching arm. The silicon plug can support the latching arm and provide an additional strength for the latching arm.

17 Claims, 2 Drawing Sheets

SOCKET WITH LATCHING UNIT

BACKGROUND OF THE INVENTION

1. Field of the Invention

The present invention relates to a socket, especially to a socket adapted for electrically connecting a module to a printed circuit board.

2. Description of the Related Art

Sockets are widely used for electrically connecting a module, such as an IC package, to a printed circuit board. Common socket comprises an insulating housing for receiving or mounting with the module and a plurality of contacts received in the housing for electrically connecting the module to the printed circuit board.

Such socket for the IC package commonly has a retaining equipment to retain the IC package in the insulating housing. The retaining equipment has a stiffener receiving the insulating housing, a loading plate pivotally assembled to an end of the stiffener to cover the insulating housing and press the IC package received in the insulating housing and a lever assembled to the other end of the stiffener to retain the loading plate to the stiffener. However, this retaining equipment does not apply to a smart module for it is too big and complex.

Hence, an improved socket is required to overcome the disadvantages of the prior art.

SUMMARY OF THE INVENTION

An object of the invention is to provide a socket, which provides a latching unit for a smart module.

To achieve the above-mentioned object, a socket comprises: a board-like housing and a plurality of latching units. The latching units are provided on the housing, each latching unit has at least one latching arm extending beyond a top surface of the housing, and a silicon plug supporting the latching arm from a back side of the latching arm.

Other features and advantages of the present invention will become more apparent to those skilled in the art upon examination of the following drawings and detailed description of preferred embodiments, in which:

DETAILED DESCRIPTION OF PREFERRED EMBODIMENT

Reference will now be made in detail to the preferred embodiment of the present invention.

Figure 1:
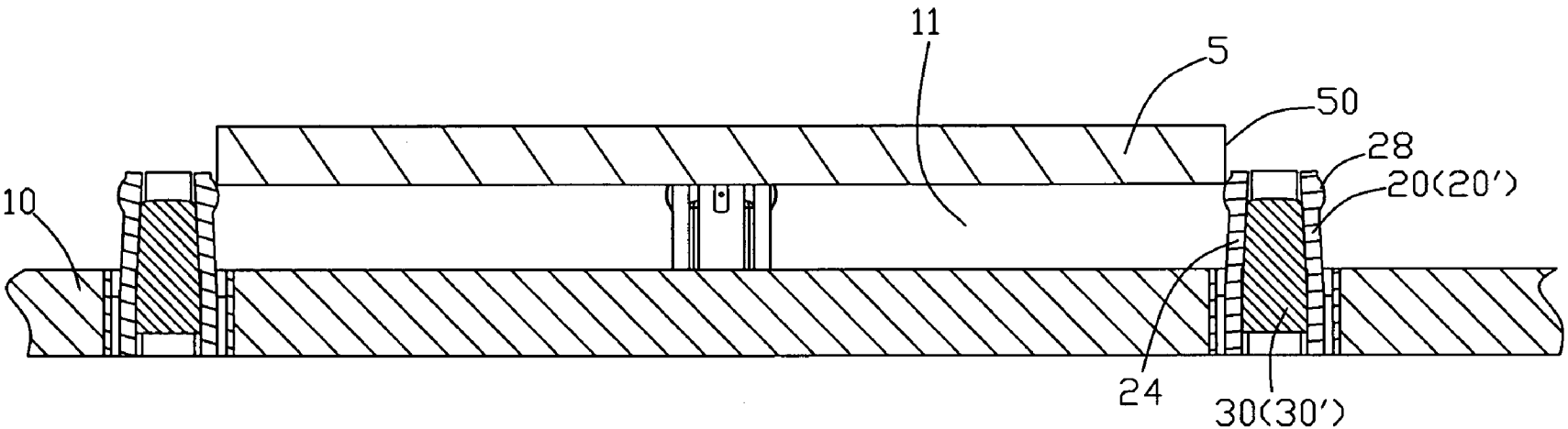
FIG. 1 is a section view of a part of a socket in accordance with a preferred embodiment of present invention, showing a latching unit of the socket engaging with a module which prepares to mount to the socket.

Referring to FIG. 1, a socket 1 in accordance with a preferred embodiment of present invention is disclosed for electrically connecting a smart module 5, such as optics modules, to a printed circuit board (not shown).

The socket 1 has a housing 10 configured in a board-like and made of plastic material. A plurality of latching units 20 are provided on the housing 10 for retaining the module 5. The latching unit 20 may be an integral part of the housing 10, and also may be a separate plastic part assembled to the housing 10.

Figure 2A:
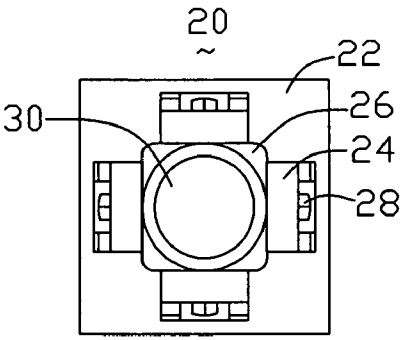
FIGS. 2A and 2B are a perspective view and a top view of the latching unit of the socket.
Figure 2B:
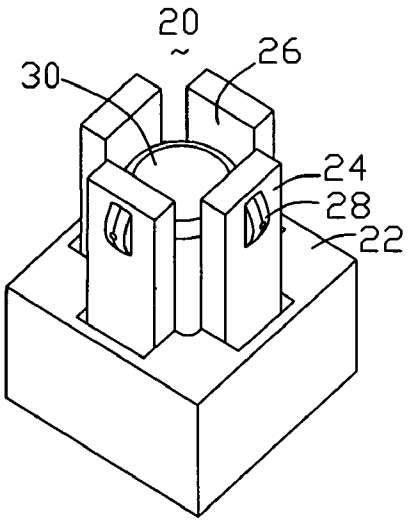

Conjoined with FIGS. 2A, 2B, each latching unit 20 has a base 22 and four latching arms 24 connecting with the base 22 and upwardly extending, the four latching arms 24 are arranged in a manner of each latching arms 24 vertical to another two adjacent latching arms 24 and the four latching arms 24 surrounding a quadrate room 26 together. Each latching arm 24 is a rectangle strip upwardly extending, a protruding portion 28 is disposed on a top end of the latching arm 24 and on an outside face of the latching arm 24 opposite to the room 26. After the latching unit 20 locates on the housing 10, the latching arms 24 extend beyond a top surface of the housing 10.

Figure 3:
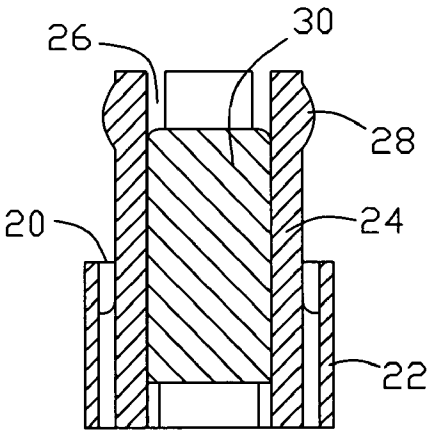
FIG. 3 is a section view of the latching unit of the socket, showing a silicon plug inserted into a room of the latching unit.

Conjoined with FIG. 3, each latching unit 20 has a columnar silicon plugs 30, which is made from a silicon material and can elastically deform. The silicon plug 30 inserts into the room 26 from a bottom side to be completely received in the room 26 of the latching unit 20. So that the silicon plug 30 abuts against each of the four latching arms 24 standing in an upright direction to support the latching arms 24 from back sides of the latching arms 24.

Figure 4A:
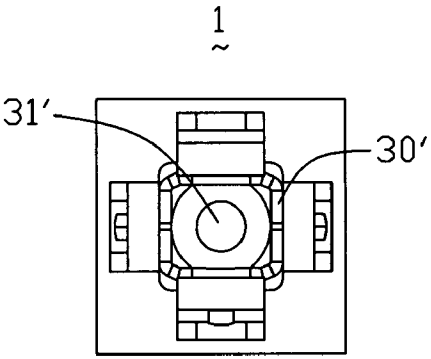
FIGS. 4A and 4B are a perspective view and a top view of an alternative latching unit of the socket in accordance with the preferred embodiment of present invention.
Figure 4B:
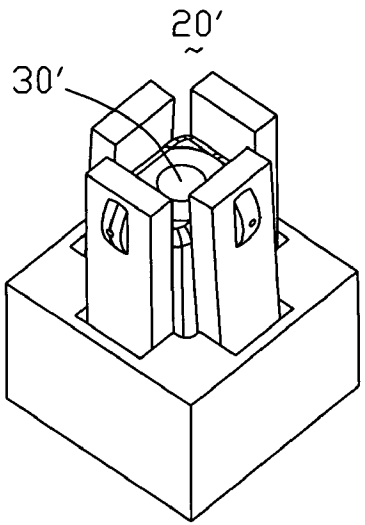

FIGS. 4A and 4B are a perspective view and a top view of alternative latching unit 20' of the socket 1 in accordance with the preferred embodiment of present invention. The latching unit 20' is same with the latching unit 20, except that a silicon plug 30' of the latching unit 20' is a cubical shape with a hollow 31' in the center thereof.

Referring to FIG. 1 again, and conjoined with FIG. 2B, when the module 5 is mounted on the socket 1, the latching arm 24 is pushed by the edges 50 of the module 5 against the silicon plug 30 (30'), then the latching arm 24 inwardly slants and causes the silicon plug 30 (30') to deform, so that the module 5 can further move downwardly. When the module 5 is positioned upon the socket 1, the latching arm 24 returns to an original position by elasticity itself or being pushed by the silicon plug 30 (30'), and the protruding portion 28 of the latching arm 24 latches with a top surface of the module 5 to retain the module 5 on the socket 1.

Since the module 5 is smart, so the latching arm 24 is designed be a small size, which results that the latching arm can not able to provide an enough retention force on the module 5, however, the silicon plug 30 supports the latching arm 24 and provides an additional strength to the latching arm 24. So that the latching unit 20 (20') can retain the module well. And the silicon plug 30 can also prevent the latching arm 24 from overstressing. Obviously, the number of latching arms 24 formed on the latching unit 20 may not be limited to four, any number latching arms 24 is possible, including only one.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. A socket, comprising:

a board-like housing; and a plurality of latching units provided on the housing, each latching unit having at least one latching arm extending beyond a top surface of the housing, and a silicon plug supporting the latching arm from a back side of the latching arm.

2. The socket as described in claim 1, wherein the latching arm can inwardly slant against the silicon plug when an outside force pushes the latching arm and can return back when the outside force releases from the latching arm.

3. The socket as described in claim 1, wherein each latching unit has four latching arms, each latching arm extending in a plane perpendicular to other two opposite planes defined by another two adjacent latching arms and the four latching arms surrounding a quadrate room for receiving the silicon plug.

4. The socket as described in claim 3, wherein the silicon plug inserts into the room from a bottom side and abuts against the four latching arms standing in an upright direction.

5. The socket as described in claim 4, wherein each latching arm is an upwardly extending rectangular strip.

6. The socket as described in claim 5, wherein a protruding portion is disposed on a top end of the latching arm to engage with a top surface of a module.

7. The socket as described in claim 1, wherein the silicon plug is a columnar shape.

8. The socket as described in claim 1, wherein the silicon plug is a cubical shape with a hollow in the center thereof.

9. A socket, adapted for a module, comprising:

a board-like housing, on which the module is mounted; and a plurality of latching units provided on the housing for retaining the module, each latching unit having at least one latching arm for latching with the module, and a deformable plug supporting the latching arm to provide an additional strength to the latching arm.

10. The socket as described in claim 9, wherein each latching unit has four latching arms, each latching arm extending in a plane perpendicular to other two opposite planes defined by another two adjacent latching arms and the four latching arms surrounding a quadrate room for receiving the plug.

11. The socket as described in claim 10, wherein each latching arm is an upwardly extending rectangular strip.

12. The socket as described in claim 11, wherein a protruding portion is disposed on a top end of the latching arm to engage with a top surface of the module.

13. A socket assembly comprising:

an insulative housing defining a horizontal base;

a plurality of latching units associated with the base, each including a first part comprising a plurality of latching arms in a symmetrical manner, each of said latching arms including an upper section exposed above an upper face of the base and a lower section embedded in the base, said lower sections of the latching arms commonly defining and surrounding a common space into which an external deformable reinforcement plug is inserted; wherein a space is formed beside the lower section opposite to the inserted plug.

14. The socket assembly as claimed in claim 13, wherein a protruding portion is formed on the upper section of the latching arm in alignment with the corresponding space therebelow in a vertical direction.

15. The socket assembly as claimed in claim 13, wherein four neighboring latching units commonly retain a module thereamong.

16. The socket assembly as claimed in claim 13, wherein each of said latching units defines two opposite latching arms in a first direction for respectively retaining two modules, respectively.

17. The socket assembly as claimed in claim 16, wherein each of said latching further defines other two opposite latching arms in a second direction perpendicular to said first direction for respectively retaining other two modules, respectively.

* * * * *